US010052749B2

(12) United States Patent
Mattson et al.

(10) Patent No.: US 10,052,749 B2
(45) Date of Patent: Aug. 21, 2018

(54) HAND POWER TOOL AND DRIVE TRAIN

(71) Applicant: BRIGHAM YOUNG UNIVERSITY, Provo, UT (US)

(72) Inventors: Christopher Mattson, Provo, UT (US); Robert Campbell, Provo, UT (US); Clark Davis, Genola, UT (US); David Olligschlager, Provo, UT (US); Brad Solomon, Springville, UT (US); Samuel Wilding, Springville, UT (US)

(73) Assignee: Brigham Young University, Provo, UT (US)

( * ) Notice: Subject to any disclaimer, the term of this patent is extended or adjusted under 35 U.S.C. 154(b) by 622 days.

(21) Appl. No.: 14/704,327

(22) Filed: May 5, 2015

(65) Prior Publication Data

US 2015/0231777 A1 Aug. 20, 2015

Related U.S. Application Data

(62) Division of application No. 13/329,251, filed on Dec. 17, 2011, now Pat. No. 9,038,745.
(Continued)

(51) Int. Cl.
*B25F 5/02* (2006.01)
*B25F 5/00* (2006.01)
(Continued)

(52) U.S. Cl.
CPC ..... *B25F 5/001* (2013.01); *B25B 21/00* (2013.01); *B25B 21/02* (2013.01); *B25F 5/02* (2013.01); *B25B 23/0028* (2013.01)

(58) Field of Classification Search
CPC ..... B25B 21/00; B25B 21/007; B25B 21/02; B25B 23/0028; B25F 5/00; B25F 5/001;
(Continued)

(56) References Cited

U.S. PATENT DOCUMENTS 1,806,582 A 5/1931 Beutner
2,106,937 A 2/1938 Tolbert, Jr.
(Continued)

OTHER PUBLICATIONS makitatools.com, "Makita Industrial Power Tools General Catalog", 2010, 108 pages.

*Primary Examiner* — Scott A. Smith
(74) *Attorney, Agent, or Firm* — Brake Hughes Bellermann LLP

(57) ABSTRACT

A drive train for supplying power to a power tool may include, a motor, a motor shaft, a rotational coupling mechanism connected to the motor shaft, and a drive shaft connected to the rotational coupling mechanism that forms the shape of a "U." A pair of enmeshed bevel gears transfers the motion from the motor shaft to an orthogonal tool bit. The drive train may also include a hammering device that transfers a rotational impacting motion to the tool bit. A hand power tool for driving a screw may include a tool shell with an integrally formed vertical handle, a rotational recess formed into the tool shell opposite the handle, and a tool chuck within the rotational recess that drives a screw. The tool may incorporate the drive train as described above. The tool may include a mechanism for locking the tool chuck in a particular position.

19 Claims, 5 Drawing Sheets

Related U.S. Application Data

(60) Provisional application No. 61/459,871, filed on Dec. 20, 2010.

(51) Int. Cl.
*B25B 21/02* (2006.01)
*B25B 21/00* (2006.01)
*B25B 23/00* (2006.01)

(58) Field of Classification Search
CPC ... B25F 5/02; B25F 3/00; B25D 16/00; B25D 17/00; B25D 17/28
USPC ..... 173/29, 42, 170, 213, 216, 217, 39; 81/57, 57.11, 57.13, 57.26, 57.28, 57.29, 81/469; 310/47, 50; 408/124, 127
See application file for complete search history.

(56) References Cited

U.S. PATENT DOCUMENTS

| | | | | |
|---|---|---|---|---|
| 2,273,626 | A | 2/1942 | Connell | |
| 2,414,637 | A | 1/1947 | Crump | |
| 4,346,767 | A | 8/1982 | Vaughan | |
| 4,347,450 | A | 8/1982 | Colligan | |
| 4,810,916 | A | 3/1989 | McBride | |
| 5,149,230 | A | 9/1992 | Nett | |
| 5,165,172 | A | 11/1992 | Weinrauch | |
| 5,533,581 | A | 7/1996 | Barth et al. | |
| 5,653,294 | A | 8/1997 | Thurler | |
| 5,784,934 | A | 7/1998 | Izumisawa | |
| 5,816,121 | A | 10/1998 | Yoshimizu et al. | |
| 6,218,746 | B1 | 4/2001 | Gouge, Jr. | |
| 6,230,717 | B1 | 5/2001 | Marx et al. | |
| 6,296,427 | B1 | 10/2001 | Potter et al. | |
| 6,461,088 | B2 | 10/2002 | Potter et al. | |
| 6,843,330 | B2 | 1/2005 | Schmid et al. | |
| 7,066,692 | B2 * | 6/2006 | Kuhn | B25F 3/00 173/216 |
| 7,204,026 | B2 | 4/2007 | Phillips et al. | |
| 7,207,233 | B2 | 4/2007 | Wadge | |
| 7,331,408 | B2 | 2/2008 | Arich et al. | |
| 7,540,335 | B2 | 6/2009 | Andriolo et al. | |
| 7,654,339 | B2 | 2/2010 | Fuchs | |
| 7,779,931 | B2 | 8/2010 | Townsan | |
| 7,926,585 | B2 | 8/2011 | Pozgay et al. | |
| 7,997,835 | B2 * | 8/2011 | Whitehead | B23B 39/205 408/124 |
| 8,209,830 | B1 * | 7/2012 | Crespo | B23B 45/003 29/26 A |
| 8,261,850 | B2 | 9/2012 | Fuchs | |
| 9,038,745 | B2 * | 5/2015 | Mattson | B25B 21/00 173/216 |
| 9,120,160 | B1 * | 9/2015 | Eldessouky | B23B 45/04 |
| 9,421,682 | B2 * | 8/2016 | McClaskey | B25F 3/00 |
| 9,539,006 | B2 * | 1/2017 | Collings | G05G 11/00 |
| 9,656,380 | B2 * | 5/2017 | Monroy | B25F 5/029 |
| 9,707,654 | B2 * | 7/2017 | Myhill | B25F 5/001 |
| 2003/0200841 | A1 | 10/2003 | Novotny | |
| 2005/0279519 | A1 | 12/2005 | Clark | |
| 2008/0084779 | A1 | 4/2008 | Lam et al. | |

* cited by examiner

HAND POWER TOOL AND DRIVE TRAIN

RELATED APPLICATIONS

This application is a divisional of and claims the benefit of U.S. patent application Ser. No. 13/329,251 entitled "Hand Power Tool and Drive Train", filed on Dec. 17, 2011, now U.S. Pat. No. 9,038,745 , which claims priority to U.S. Provisional Patent Application Number 61/459,871 entitled "Combination Impact Driver and Ninety Degree Driver" and filed on 20 Dec. 2010, the contents of which are incorporated herein by reference in their entireties.

BACKGROUND OF THE INVENTION

Field of the Invention

This invention relates generally to hand power tools and more particularly relates to a drive train for supplying power to a powered hand tool.

Description of the Related Art

Impact drivers are rotary tools that incorporate a rotational impacting motion to drive a screw into a medium. Ninety degree drivers have swiveling heads that allow a user to drive a screw into a medium in tight spaces. Often times a project requires the use of both drivers. Providing a drive train that powers both an impact driver and a ninety degree driver, would therefore provide advantages that are lacking in currently available drivers.

SUMMARY OF THE INVENTION

The present invention has been developed in response to the present state of the art, and in particular, in response to the problems and needs in the art that have not yet been fully solved by currently available drive trains. Accordingly, the present invention has been developed to provide a drive train that supplies power to a combined impact driver and ninety degree driver that overcomes many of the shortcomings in the art.

As described below, a drive train for supplying power to a power tool may include, a motor that supplies electrical power, a motor shaft connected to the motor, a rotational coupling mechanism that is connected perpendicular to the motor shaft, and a drive shaft that is connected perpendicular to the rotational coupling mechanism. In one embodiment, the drive train forms the shape of a "U." A pair of enmeshed bevel gears may transfer the motion from the motor shaft to an orthogonal tool bit. The drive train may also include a hammering device that transfers a rotational impacting motion to the tool bit.

Additionally, as described below, a hand power tool for driving a screw into a medium may include, a tool shell having an aperture with an integrally formed vertical handle, a rotational recess formed into a portion of the tool shell opposite the handle, and a rotating tool chuck located within the rotational recess that drives a screw into a medium. In one example, the power tool may incorporate the drive train as described herein. The hand power tool may also include a mechanism for selectively rotating the tool chuck and locking it in a particular position.

The present invention provides a variety of advantages. It should be noted that references to features, advantages, or similar language within this specification does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention.

The aforementioned features and advantages of the present invention will become more fully apparent from the following description and appended claims, or may be learned by the practice of the invention as set forth hereinafter.

BRIEF DESCRIPTION OF THE DRAWINGS

To enable the advantages of the invention to be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Figure 1:
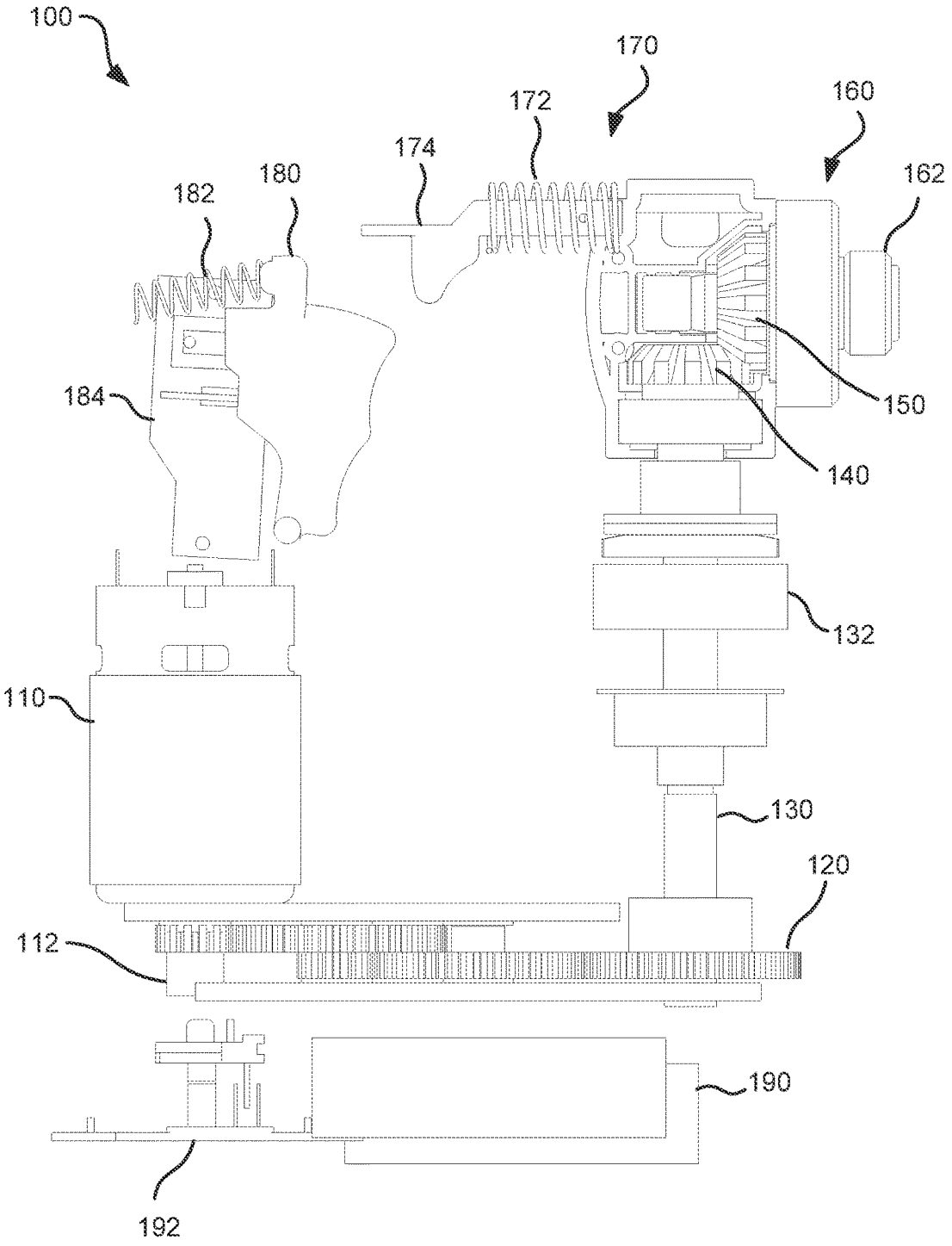
FIG. 1 is detailed side view illustration of one embodiment of a drive train of the present invention suitable for a powered hand tool.

FIG. 1 is detailed side view illustration of one embodiment of a drive train for a powered hand tool 100 of the present invention. As depicted, the drive train 100 includes a motor 110 with an attached motor shaft 112, a rotational coupling mechanism 120, a drive shaft 130, a pair of bevel gears 140, 150, a tool chuck assembly 160 with a tool chuck 162, a locking mechanism 170, a speed controller 180, and a battery 190.

The drive train 100 may include a motor 110 which converts electrical power into rotational motion. In certain embodiments the motor 110 may be a reversible motor capable of providing rotational motion in either a clockwise or a counter clockwise direction. The electrical power may be supplied to the motor 110 by a battery 190 electrically coupled to the motor through the battery board 192. The motor 110 may be attached to a rotational coupling mechanism 120 through a motor shaft 112. According to one embodiment, the rotational coupling mechanism 120 is positioned perpendicular to the motor 110. Examples of rotational coupling mechanisms 120 include, but are not limited to, a gear set, a belt, a chain, and a sun gear. A drive shaft 130 may be mechanically coupled to the rotational coupling mechanism 120 opposite the motor shaft 112. According to one example, the drive shaft 130 may be positioned perpendicular to the rotational coupling mechanism 120. In this example, the drive shaft 130 is parallel to the motor shaft.

The drive train also may include a first bevel gear 140 coupled to the drive shaft 130. A second bevel gear 150, orthogonally enmeshed with the first bevel gear 140, may convert the rotational motion from a generally vertical axis to a generally horizontal axis. In one embodiment, the drive train 100 may also include a hammering device 132. The hammering device 132 converts a portion of the rotational motion supplied by the motor 110 into a rotational impacting motion. This rotational impacting motion is similarly converted from a generally vertical axis to a generally horizontal axis through the bevel gears 140, 150, which are housed in the tool chuck assembly 160. The tool chuck assembly 160 may house a tool chuck 162 that is mechanically coupled to the second bevel gear 150. The tool chuck 162 may be configured to receive a tool bit.

According to one embodiment the tool chuck assembly 160 is configured to rotate about a generally vertical axis. For example, the second bevel gear 150 and the tool chuck 162 may rotate along with the tool chuck assembly 160 and the second bevel gear 150 may be continually enmeshed with the first bevel gear 140 such that tool chuck 162 is rotationally coupled to the drive shaft 130 at all times.

In one embodiment where the tool chuck assembly 160 is configured to rotate, the drive train may include a locking mechanism 170 that maintains the tool chuck assembly 160 in a selected position. The locking mechanism 170 may include a spring-loaded shaft 172 that locks the tool chuck assembly 160 in a selected position. A trigger 174 coupled to the spring-loaded shaft 172 may allow a user to disengage the spring-loaded shaft 172 from the tool chuck assembly 160 such that it may be freely rotated.

The drive train 100 may include a speed controller 180 which allows a user to activate the motor 110. In one example, the speed controller 180 may include a speed board 184 that completes an electric circuit between the battery 190 and the motor 110 when the spring 182 is compressed. When the spring 182 is not compressed, no power is supplied. Moreover, the drive train 100 may include a battery 190 that supplies electric power to the motor 110 through the battery board 192. While in the depicted view the battery 190 is located below the rotational coupling mechanism 120, the battery 190 may be located at any position along the drive train 100.

Figure 2:
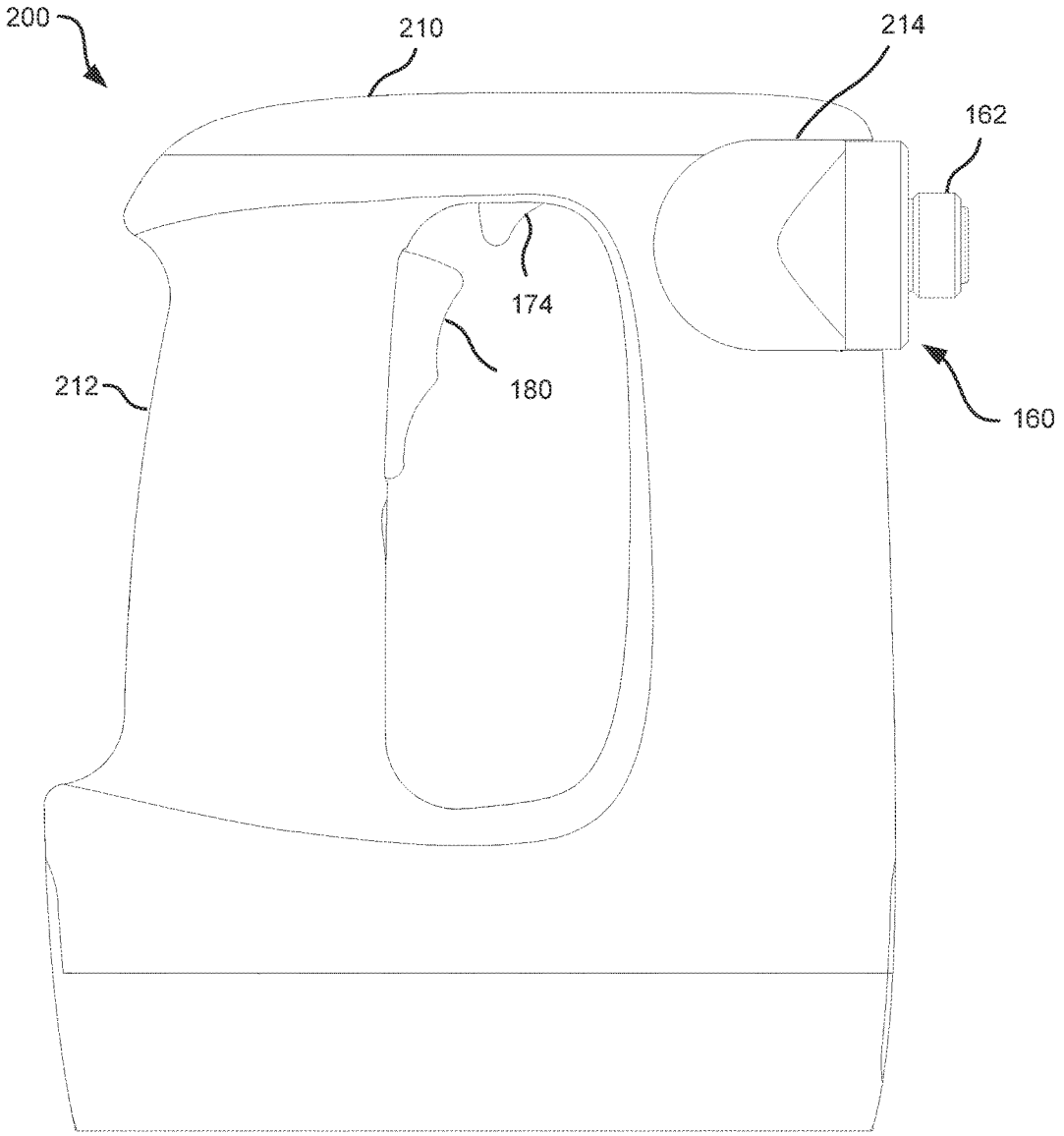
FIG. 2 is a detailed side view illustration of one embodiment of a powered hand tool of the present invention.

FIG. 2 is a detailed side view illustrations of one embodiment of a powered hand tool 200 of the present invention. As depicted the hand tool 200 may include, a tool shell 210 with an integrally formed handle 212, a rotational recess 214 disposed within the tool shell 210 opposite the handle 212, the tool chuck assembly 160 with the tool chuck 162, the speed controller, and the trigger 1744.

In one embodiment the hand tool 200 includes a tool shell 210 that has an aperture at its center. The handle 212 may be integrally formed into one side of the tool shell 210. The speed controller 180 may be positioned within the aperture, on the same side of the tool shell 210 as the handle 212, which would allow a user to change the speed of the motor (not shown) while gripping the handle 212. The trigger 174 may also be placed within the aperture such that it could be easily engaged and allow the tool chuck assembly 160 to freely rotate.

The power tool 200 may also include a rotational recess 214 integrally formed into the tool shell 210. According to one embodiment, the rotational recess 214 is positioned on a side of the tool shell 210 opposite the handle 212. In this example, a user may exert force on the handle 212, which transfers through the tool shell 210 directly to the tool chuck assembly 160 and tool chuck 162 which are housed in the rotational recess 214. This improves the driving force of the power tool 200. In this example, the rotational recess 214 may be disposed near a top portion of the tool shell 210.

Figure 2A:
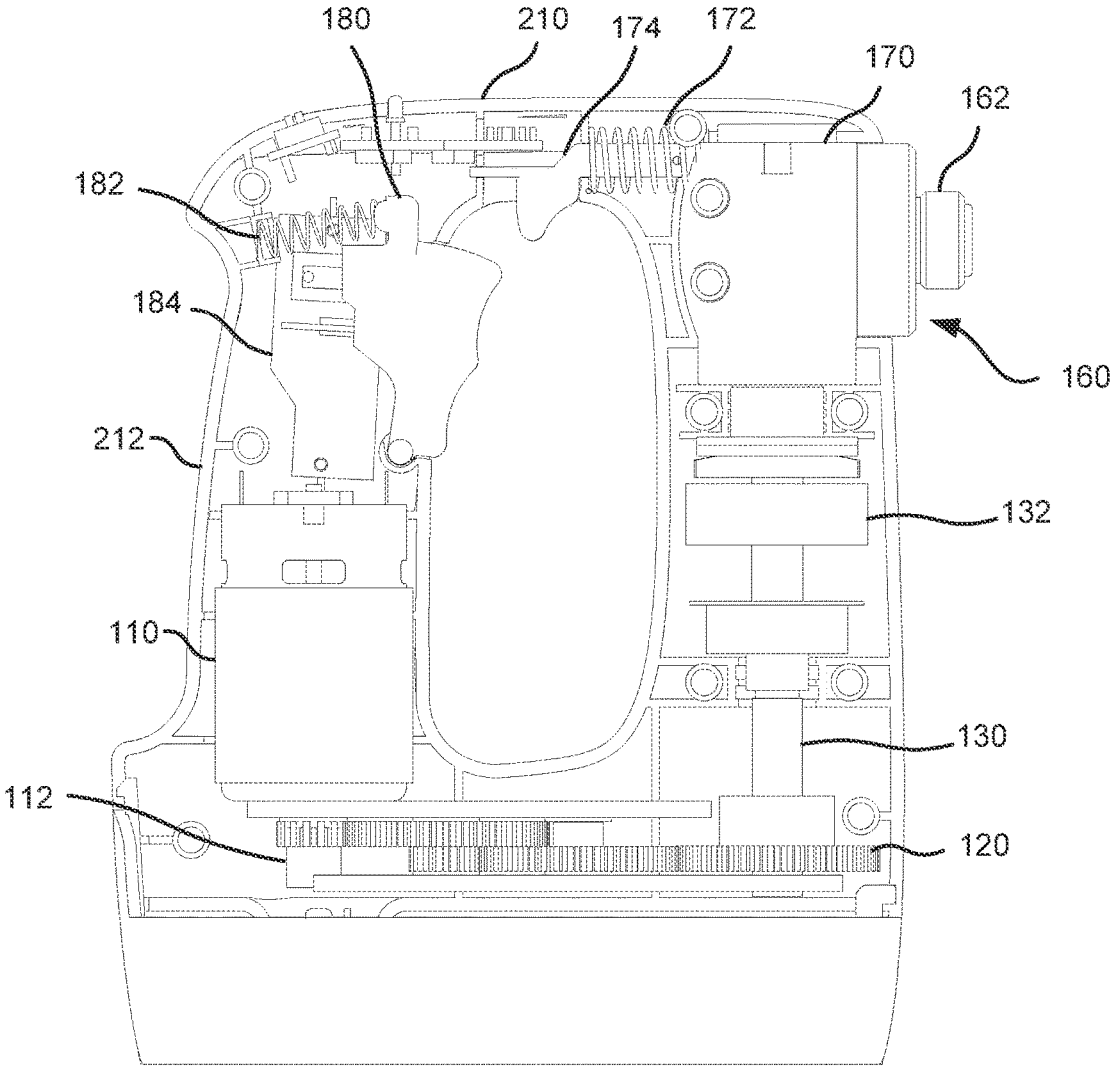
FIG. 2*a* is a detailed sectional side view illustration of one embodiment of a powered hand tool of the present invention.

FIG. 2*a* is a detailed sectional side view illustration of one embodiment of a powered hand tool 200 of the present invention. As depicted, the hand tool 200 includes the motor 110 and motor shaft 112, rotational coupling mechanism 120, drive shaft 130, hammering device 132, tool chuck assembly 160 with the tool chuck 162, locking mechanism 170, and speed controller 180 as described in FIG. 1, disposed within the tool shell 210. In this embodiment, the battery (not shown) is disposed within the tool shell 210.

According to one embodiment the motor 110 and motor shaft 112 are disposed within the tool shell 210 on the same side as the handle 212. The drive shaft 130 and bevel gears 140, 150 may be positioned within the tool shell 210 on a side opposite the motor 110 and motor shaft 112.

According to another embodiment, the battery 190 is disposed within the tool shell on the same side as the handle 214. In this embodiment the motor 110, motor shaft, 112, drive shaft 130 and bevel gears 140, 150 are positioned within the tool shell 210 on a side opposite the battery 190.

Figure 3:
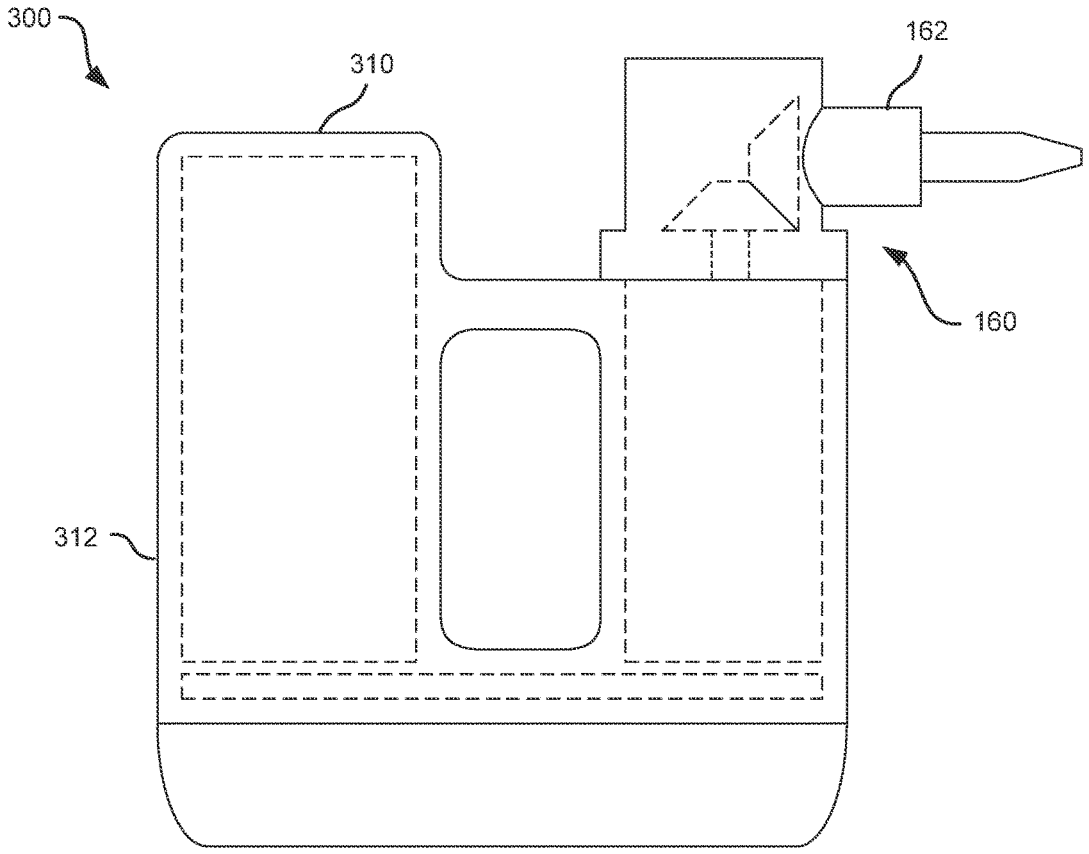
FIG. 3 is a side view illustration of one embodiment of a powered hand tool of the present invention.

FIG. 3 is a side view illustration of one embodiment of a powered hand tool 300 of the present invention. As depicted the hand tool 300 may include a tool shell 310 with an integrally formed handle 312, and the tool chuck assembly 160 with the tool chuck. In one embodiment the hand tool 300 includes a tool shell 310 that has an aperture at its center. A handle 312 may be integrally formed into one side of the tool shell 310. The speed controller (not shown) may be positioned within the aperture on the same side of the tool shell 310 as the handle, which would allow a user to easily change the speed of the motor (not shown) while gripping the handle 312. The trigger (not shown) may also be placed within the aperture such that it could be engaged and allow the tool chuck assembly 160 to freely rotate.

The power tool 300 may also include the tool chuck assembly 160 with the tool chuck 162 positioned vertical to the tool shell 310 on a side opposite the handle 312. Similar to the power tool in FIG. 2, aligning the chuck assembly 160 and handle 312 in this fashion allows the power tool 300 greater driving force.

Figure 4:
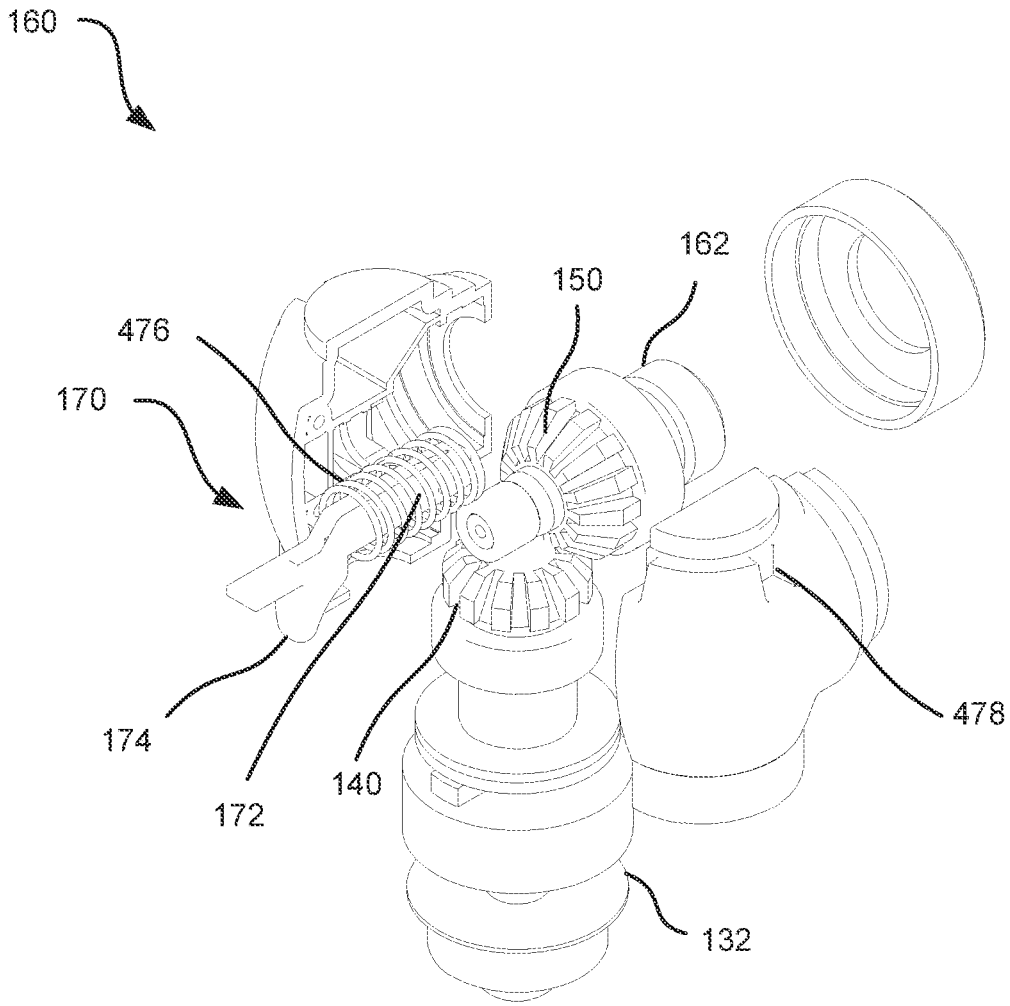
FIG. 4 is an exploded perspective view illustration of one embodiment of a tool chuck assembly of the present invention.

FIG. 4 is an exploded perspective view illustration of one embodiment of a tool chuck assembly 160 of the present invention. As depicted, the tool chuck assembly 160 may include the drive shaft 130, the first bevel gear 140, the second bevel gear 150, and the tool chuck 162. The tool chuck assembly 160 may also include a locking mechanism 170 that allows a user to disengage the tool chuck assembly 160 such that it may freely rotate. In this example, the locking mechanism 170 may include a spring-loaded shaft 172 that interacts with a number of indentations 478 that are positioned along the outside surface of the tool chuck assembly 160. As the trigger 174 is activated, a spring 476 may be compressed which disengages the spring-loaded shaft 172 from the indentations 478. In this configuration, the tool chuck assembly 160 may freely rotate about a generally vertical axis.

The present invention provides an improved hand power tool and drive train. The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A hand power tool, comprising:
- a hollow shell having a closed curve shape including a distal portion and a proximal portion, with an aperture defined between the distal portion and the proximal portion;
- a rotational recess defined in the distal portion of the shell; and
- a tool chuck assembly rotatably coupled in the rotational recess, the tool chuck assembly rotating in the rotational recess about a first axis, the tool chuck assembly including a tool chuck configured to secure a tool bit, the tool chuck and tool bit secured therein rotating about a second axis that is perpendicular to the first axis.

2. The hand power tool of claim 1, wherein the proximal portion of the shell and the aperture together define a handle configured to be grasped by a user, and wherein the rotational recess is defined in an upper end portion of the distal portion of the shell.

3. The hand power tool of claim 1, further comprising a drive train received in the hollow shell, the drive train including:
- a motor and a motor shaft;
- a drive shaft in the distal portion of the shell;
- a rotational coupling device coupling the motor shaft and the drive shaft;
- a hammering device coupled to the drive shaft; and
- a bevel gear assembly coupled between the hammering device and the tool chuck, the bevel gear assembly converting a rotational force from the drive shaft parallel to the first axis of rotation to a rotational force about the second axis of rotation for rotation of the tool chuck about the second axis of rotation.

4. The hand power tool of claim 3, wherein:
- the motor and motor shaft are in the proximal portion of the shell;
- the drive shaft and bevel gear assembly are in the distal portion of the shell; and
- the rotational coupling mechanism is in a portion of the shell connecting a lower end portion of the proximal portion of the shell to a lower end portion of the distal portion of the shell.

5. The hand power tool of claim 3, further comprising a power supply coupled to supply electrical power to the motor, wherein the power supply is received in the hollow shell or is coupled to an exterior of the hollow shell.

6. The hand power tool of claim 1, wherein the tool chuck assembly is rotatable in the rotational recess about the first axis of rotation to a plurality of angular positions.

7. The hand power tool of claim 6, further comprising a locking mechanism selectively coupled to the tool chuck assembly to selectively lock the tool chuck assembly in a selected position of the plurality of angular positions.

8. The hand power tool of claim 7, wherein, in a first mode the tool chuck is rotatable about the first axis of rotation to the plurality of angular positions and, in a second mode the tool chuck is locked in the selected position of the plurality of angular positions by the locking mechanism and is rotatable about the second axis of rotation in response to operation of the motor.

9. The hand power tool of claim 7, wherein the locking mechanism includes:
- a plurality of indentations defined in a surface of the tool chuck assembly corresponding to the plurality of angular positions;
- a spring-loaded shaft that selectively engages one of the plurality of indentations to lock the tool chuck assembly in the selected angular position; and
- a first trigger connected to the spring-loaded shaft and extending out of the shell to selectively engage the spring-loaded shaft with one of the plurality of indentations and disengage the spring-loaded shaft from one of the plurality of indentations.

10. The hand power tool of claim 9, wherein, in a first mode, the first trigger is actuated to compress a spring of the spring-loaded shaft and disengage the spring-loaded shaft from the one of the plurality of indentations so that the tool chuck assembly is rotatable in the rotational recess about the first axis to the plurality of different angular positions.

11. The hand power tool of claim 10, wherein, in a second mode, the first trigger is released and the spring is released to bias the spring-loaded shaft in an engaged position with respect to one of the plurality of indentations to fix the tool chuck assembly in a selected one of the plurality of angular positions, the tool chuck being rotatable about the second axis of rotation in the second mode.

12. The hand power tool of claim 9, further comprising a speed controller controlling actuation and speed of the motor, the speed controller including:
- a speed board selectively controlling a supply of power to the motor; and
- a second trigger connected to the speed board by a spring, the second trigger extending out of the hollow shell such that external actuation of the second trigger compresses the spring to supply power to the motor.

13. The hand power tool of claim 12, wherein the first trigger extends out of the hollow shell and into the aperture at an upper portion of the aperture for selective actuation by a user grasping a handle portion of the proximal portion of the shell, and the second trigger extends out of the proximal portion of the hollow shell and into the aperture at an intermediate portion of the aperture for selective actuation by a user grasping the handle portion of the proximal portion of the shell.

14. A hand power tool, comprising:
- a hollow shell, including:
  - a proximal section defining a handle;
  - a distal section spaced apart from and in parallel to the proximal section;
  - an upper section connecting an upper end portion of the proximal section to an upper end portion of the distal section; and a lower section connecting a lower end portion of the proximal section to a lower end portion of the distal section, the proximal, distal, upper and lower sections defining a closed curve shape having a central aperture;

a rotational recess defined in the shell, where the upper section joins the distal section;

a tool chuck assembly rotatably coupled in the rotational recess; and a drive train, including a motor in the proximal section, and a drive shaft and bevel gear assembly in the distal section, coupled to the tool chuck assembly, the drive shaft connected to the motor by a rotatable coupling device in the lower section to transfer a rotational force generated by the motor to the tool chuck assembly.

15. The hand power tool of claim 14, wherein the tool chuck assembly includes:

a housing rotatably coupled in the rotational recess, the housing rotating about a first axis of rotation to a plurality of angular positions; and a tool chuck coupled in the housing and configured to secure a tool bit, the tool chuck rotating about a second axis of rotation that is perpendicular to the first axis of rotation.

16. The hand power tool of claim 15, further comprising a locking mechanism selectively coupled to the tool chuck assembly to selectively lock the tool chuck assembly in a selected position of the plurality of angular positions, the locking mechanism including:

a plurality of indentations defined in an outer surface of the housing corresponding to the plurality of angular positions;

a spring-loaded shaft that selectively engages one of the plurality of indentations; and a first trigger connected to the spring-loaded shaft, wherein engagement between the spring loaded shaft and the one of the plurality of indentations is released in response to actuation of the trigger such that the tool chuck assembly is rotatable in the rotational recess, and engagement between the spring loaded shaft and the one of the plurality of indentations is fixed in response to release of the trigger such that an angular position of the tool chuck assembly is fixed.

17. The hand power tool of claim 16, further comprising a speed controller controlling actuation and speed of the motor, the speed controller including:

a speed board selectively controlling a supply of power to the motor; and a second trigger connected to the speed board, wherein external actuation of the second trigger positions the speed board to supply power to the motor.

18. The hand power tool of claim 17, wherein the first trigger extends out of upper portion of the shell and into the aperture, and the second trigger extends out of the proximal portion of the hollow shell, at the handle, and into the aperture such that a speed of the motor is controllable by a user grasping the handle.

19. The hand power tool of claim 17, wherein in an operational mode, the first trigger is released to bias the spring-loaded shaft in an engaged position with respect to one of the plurality of indentations to fix the tool chuck assembly in a selected one of the plurality of angular positions, the tool chuck being rotatable about the second axis of rotation in the operational mode in response to a rotational force generated by the motor.

* * * * *